United States Patent [19]

Pitts

[11] Patent Number: 4,516,634

[45] Date of Patent: May 14, 1985

[54] HYDRAULIC RUNNING AND SETTING TOOL FOR WELL PACKER

[75] Inventor: Glen E. Pitts, The Colony, Tex.

[73] Assignee: Otis Engineering Corporation, Dallas, Tex.

[21] Appl. No.: 485,017

[22] Filed: Apr. 14, 1983

[51] Int. Cl.[3] ..... E21B 33/128

[52] U.S. Cl. ..... 166/120; 166/125; 166/212

[58] Field of Search ..... 166/120, 127, 125, 134, 166/181, 182, 237, 212, 382

[56] References Cited

U.S. PATENT DOCUMENTS

| | | | |
|---|---|---|---|
| 3,102,594 | 9/1963 | Crowe | 166/125 |
| 3,306,359 | 2/1967 | Edwards, Jr. | 166/212 |
| 3,631,925 | 1/1972 | Nutter | 166/123 |
| 3,631,927 | 1/1972 | Young | 166/125 |
| 4,030,544 | 6/1977 | Ahlstore | 166/182 |

*Primary Examiner*—William F. Pate, III

*Attorney, Agent, or Firm*—H. Mathews Garland

[57] ABSTRACT

A hydraulic running and setting tool for a well packer including an annular cylinder body having a top sub for connection with a tubing handling string, a longitudinal operator tube releasably secured at a first upper end in the top sub, a first locking collet assembly for releasably coupling with a packer body including a collet connected with the top sub and a collet locking surface along the second end of the operator tube, an annular piston in the cylinder body, and a second locking collet assembly releasably connected with the piston for operating a packer setting sleeve. Shear pins in the running tool isolated from weight forces applied to the running tool by the packer control the setting sequence while the packer remains fully coupled by the first collet assembly. The release of the first locking collet assembly is a distinct separate step from the packer setting sequence permitting manipulation of the packer to check if properly set and for pressure testing while the running tool remains coupled with the packer.

16 Claims, 8 Drawing Figures

HYDRAULIC RUNNING AND SETTING TOOL FOR WELL PACKER

Figure 1A:
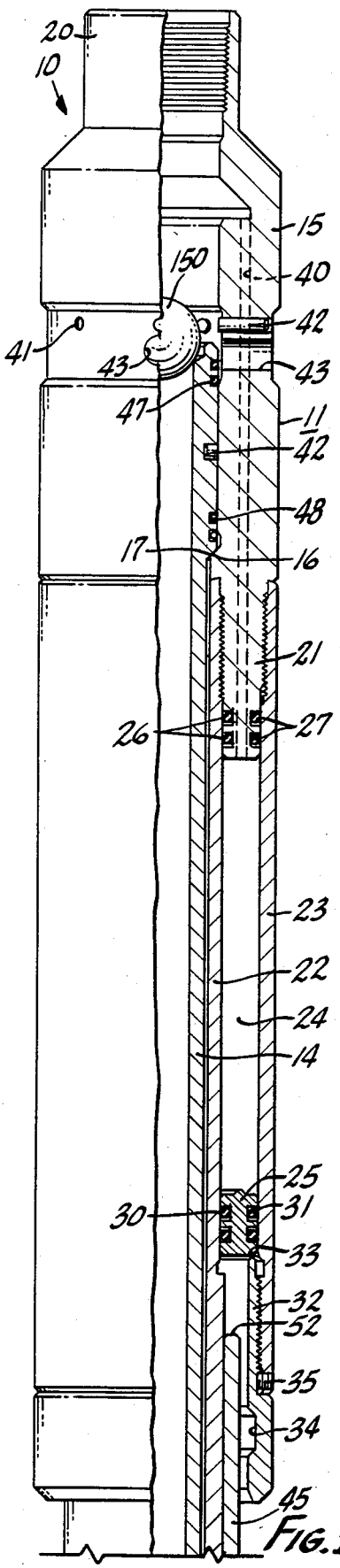

This invention relates to well tools and more particularly relates to a running and setting tool for a well packer.

Packers are set in oil and gas wells for isolating producing zones and directing fluids from the producing zones into well tubing and casing for flow to the surface. Such well packers are run and set in well bores using various methods and apparatus including releasably coupling the packer on the lower end of a tubing string which is used to lower the packer in the well bore and manipulate the packer until it is set at the proper depth. Prior art packer running and setting tools have included setting apparatus provided with shear pins which provide both weight supporting functions and packer setting sequence control. Such pins frequently wear sufficiently before the packer has reached setting depth that the pins shear prematurely. Under such circumstances if additional pins are employed to prevent premature shearing frequently more force is required for shearing them than can normally be applied. Particular operating conditions which frequently cause premature shearing of pins includes the starting and stopping of the tubing string while making up pipe as the string is lowered causing impact forces which may shear the pins. Additionally the packer and running tool frequently may encounter obstructions as the string is lowered in a well bore. Where shear pins are the primary coupling with the running tool the pins may fall out or become damaged as the packer is run causing malfunctioning. Further disadvantages of the use of shear pins as the primary connection between the packer and running tool is that after the pins are sheared upward and downward forces cannot be applied to the packer to determine if the packer is properly set and to pressure test the packer. Under extreme adverse conditions a packer connected by shear pins may become lost in the bore hole due to malfunctioning of the pins.

It is an object of the invention to provide a new and improved hydraulic running and setting tool for a well packer.

It is an especially important object of the invention to provide a well packer running and setting tool wherein the weight of the well packer and any apparatus connected to the packer is not supported by shear pins on the running tool.

It is another object of the invention to provide a well packer running tool including a coupling assembly for releasable connection with the packer which remains functional until the packer is fully set in the well bore and a separate positive release step is taken to detach the running tool from the packer.

It is another object of the invention to provide a well packer running tool including a weight supporting collet assembly for connecting and supporting the packer from the running tool and non-weight supporting shear pins for controlling the operating sequence of the setting of the packer.

It is another object of the invention to provide a well packer running tool utilizing shear pins which will not function prematurely to accidentally release the packer from the running tool.

It is another object of the invention to provide a well packer running tool which remains coupled with the well packer after shear pins controlling the running tool are sheared so that the packer may be checked to determine if it is properly set and may be pressure tested.

It is another object of the invention to provide a well packer running tool which includes setting shear pins which are isolated from forces such as weight until the packer is set.

In accordance with the invention there is provided a hydraulic running and setting tool for a well packer including a hydraulic operating cylinder assembly coupled with a packer setting sleeve and with the packer mandrel by first and second collet assemblies connected with the packer mandrel and setting sleeve respectively and weight isolated shear pins for controlling the setting sequence of the packer. The first collet assembly coupled with the packer mandrel remains connected with the packer until all shear pins controlling the setting of the packer have been severed.

Figure 1B:
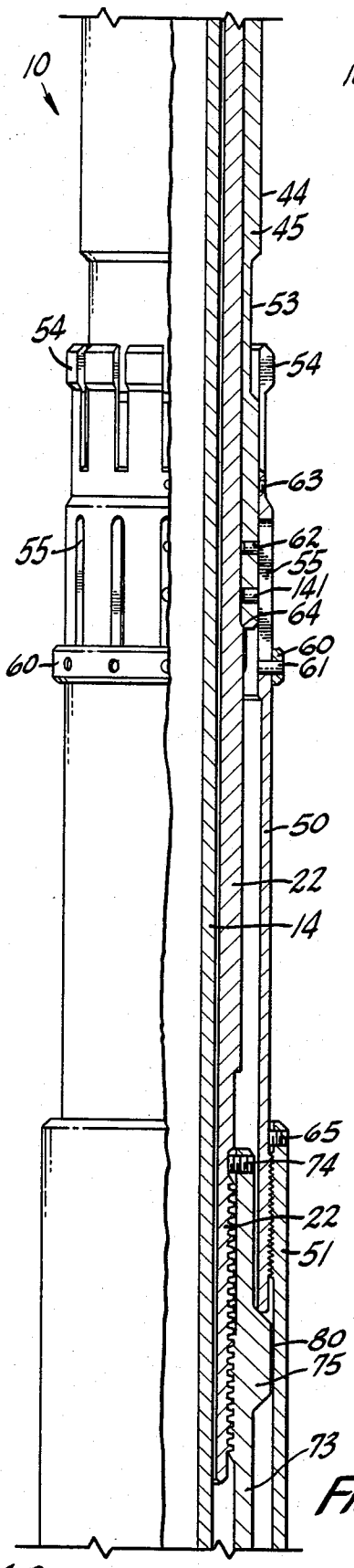
Figure 1C:
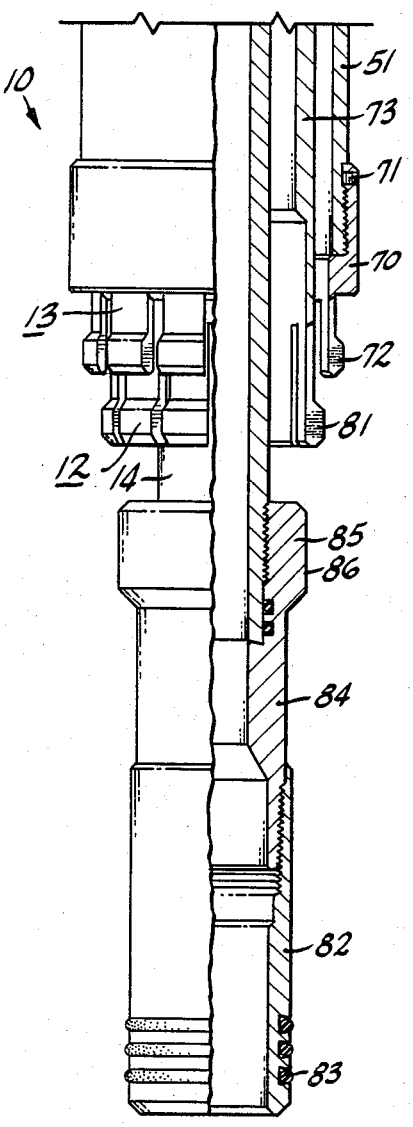
Figure 3:
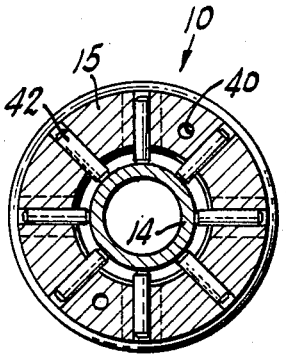
Figure 2A:
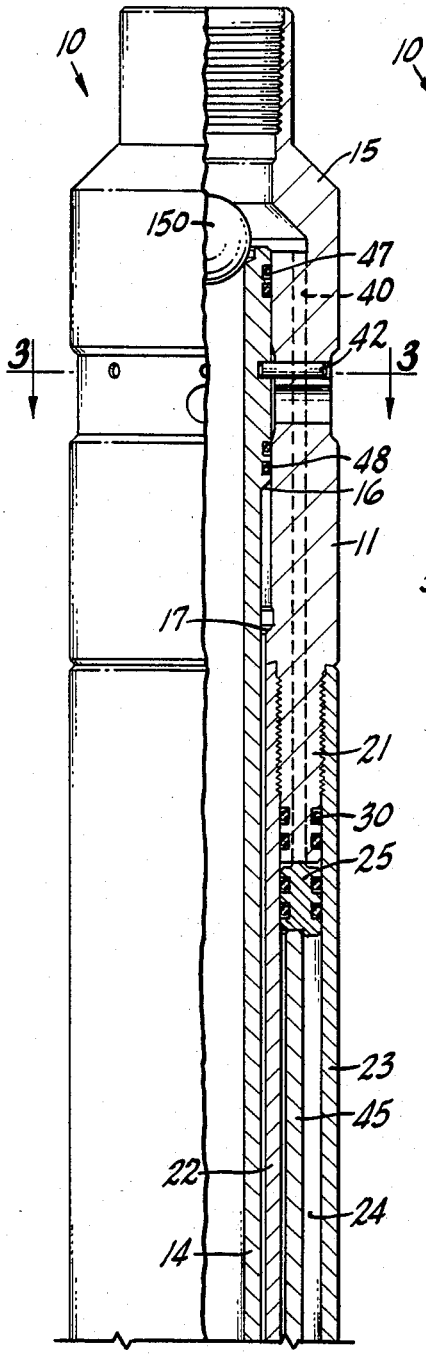

The foregoing objects and advantages together with specific details of a preferred embodiment of the invention will be better understood from the following detailed description taken in conjunction with the accompanying drawings wherein:

FIGS 1A, 1B, and 1C taken together form a longitudinal view in section and elevation of a packer running and setting tool embodying the features of the invention showing the various parts of the tool at relative positions after the tool has been used to set and removed from a packer;

FIGS. 2A, 2B, 2C and 2D taken together form a longitudinal view in section and elevation of the running and setting tool of the invention connected with a well packer preparatory to running the packer in a well bore; and FIG 3 is a view in section along the line 3—3 of FIG. 2A.

Referring to FIGS. 1A, 1B and 1C, a packer running and setting tool 10 embodying the features of the invention includes an annular hydraulic operating cylinder assembly 11, a locking collet 12 for coupling with a well packer body mandrel, a collet 13 for connection with a setting sleeve of a packer, and a releasably secured longitudinally movable operator tube 14 for manipulating the collet 12. The running tool is coupled with a well packer by connection of the collet 12 with the body mandrel of the packer and the collet 13 with the setting sleeve of the packer and the tool is shear pinned in running condition with the packer which is then lowered by a tubing string connected with the running tool, the packer is hydraulically set, and thereafter the operating tube 14 is hydraulically moved to release the collet 12 from the packer independently of the setting procedure.

The hydraulic cylinder assembly 11 includes a top sub 15 having an internally threaded reduced head end 20 for connection of the sub with a supporting tubing string, not shown, for lowering the running tool and packer in a well bore and directing hydraulic operating fluid to the setting tool. The top sub 15 is connected along an internally and externally threaded lower end portion 21 with a tubular body 22 and a tubular skirt 23 arranged in concentric spaced relation defining an annular hydraulic operating cylinder 24. Internal and external ring seals 26 and 27, respectively, seal between the lower end portion of the top sub and the inside walls of the body 22 and the skirt 23. An annular piston 25 is movable longitudinally within the annular cylinder 24. The piston has internal and external seals 30 and 31 respectively for sealing around the piston with the inner walls of the body 22 and skirt 23 defining the hydraulic cylinder 24. A tubular retainer 32 is threaded into the lower end of the skirt 23. The inside end edge 33 of the retainer 32 provides a stop for the piston 25 limiting the lower end position of the piston as shown in FIG. 1A The retainer 32 has an internal annular collet finger locking recess 34 which functions in restraining the setting sleeve of a packer as described hereinafter. The retainer 32 is held against unscrewing by set screws 35 threaded through the wall of the sleeve 23 against the retainer.

As illustrated in FIGS. 1A and 3, the wall of the top sub 15 has a plurality of longitudinal circumferentially spaced flow passages 40 for flow of hydraulic fluid into the annular cylinder 24 to operate the piston 25. The top sub also has a plurality of radial circumferentially spaced shear screw holes 41 which receive shear screws 42 used to releasably secure the operating tube 14 in running position as illustrated in FIG. 2A. A plurality of circumferentially spaced radial bypass ports 43 are provided in the top sub to allow fluid drainage from the running tool and supporting tubing string when pulling the tool from a well bore.

A piston operated tube assembly 44 for transmitting force from the annular piston 25 to set upper packer slips is formed by tubes 45, 50 and 51. The tube assembly 44 slides on the tool body 22. The tube 45 telescopes into the cylinder sleeve 23 for engagement on the end edge 52 with the bottom face of the piston 25. An external annular collet release recess 53 is formed on the tube 45. A lower end portion of the tube 45 telescopes into the tube 50 A plurality of circumferentially spaced locking collet fingers 54 are formed along the upper end portion of the tube 50. A plurality of circumferentially spaced slots 55 are formed in the tube 50 below the collet fingers 54. A retainer ring 60 is slidably mounted on the tube 50 for supporting a plurality of pins 61 which perform both a force transmitting function for setting upper packer slips and a shear pin function during the packer running tool operating process. The pins 61 are circumferentially spaced around the ring 60 each sliding in one of the slots 55 in the tube 50. The tube 45 has shear pin holes 62 and the tube 50 has shear pin holes 63 permitting the tube 45 and the tube 50 to be connected together by shear pins in the running position of the setting tool. The body 22 has an external annular stop shoulder 64 which is engageable by the lower end edge of the tube 45 limiting the downward movement of the tube 45 on the body 22 as shown in FIG. 1B. The upper end portion of the tube 51 threads on the lower end portion of the tube 50 held against unscrewing by a set screw 65. As seen in FIG. 1C, the collet 13 is threaded on the lower end portion of the tube 51. The collet 13 comprises a body ring 70 held against unscrewing on the tube 51 by set screw 71. The collet 13 has a plurality of downwardly extending circumferentially spaced operating collet fingers 72.

Referring to FIGS. 1B and 1C, the collet 12 comprises a tubular body 73 threaded along an upper end portion on the lower end portion of the body 22 and held against unscrewing by set screw 74. The body 73 has an external annular boss 75 provided with a cylindrical collet locking surface 80 which functions to hold the collet finger 72 in locking positions at the running position of the tool, The collet 12 also includes downwardly extending circumferentially spaced collet fingers 81 which provide the primary connection between the running tool and a packer body mandrel.

Referring to FIG. 1C, a tubular seal unit 82 having external annular seals 83 is mounted on the lower end of the operator tube 14 by a tubular coupling 84. The upper end portion of the coupling 84 has an external annular boss 85 provided with a cylindrical locking surface 86 which functions to hold the collet fingers 81 in locking positions at the running position of the tool.

Figure 2B:
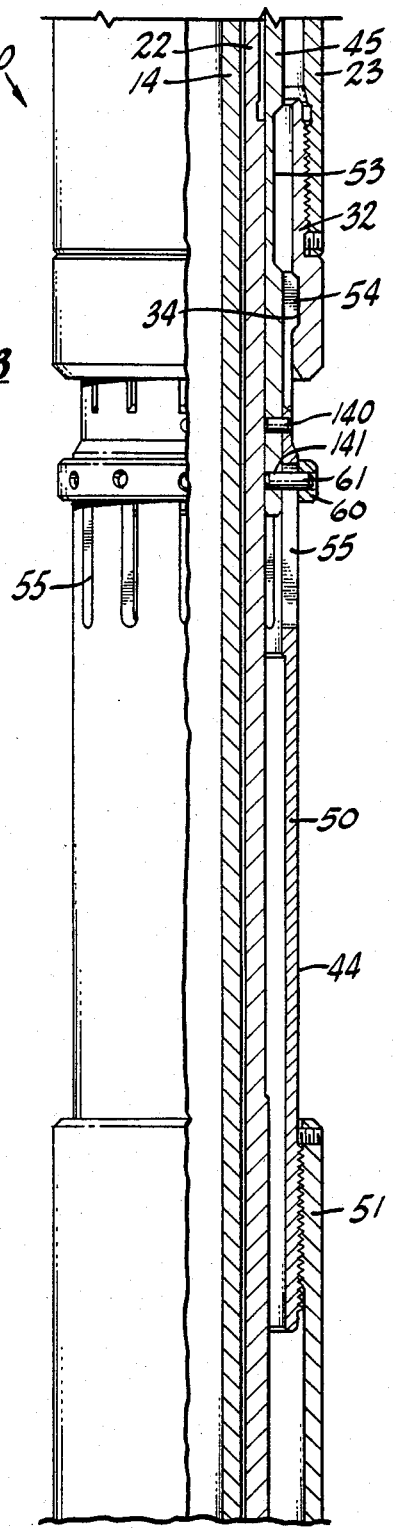
Figure 2C:
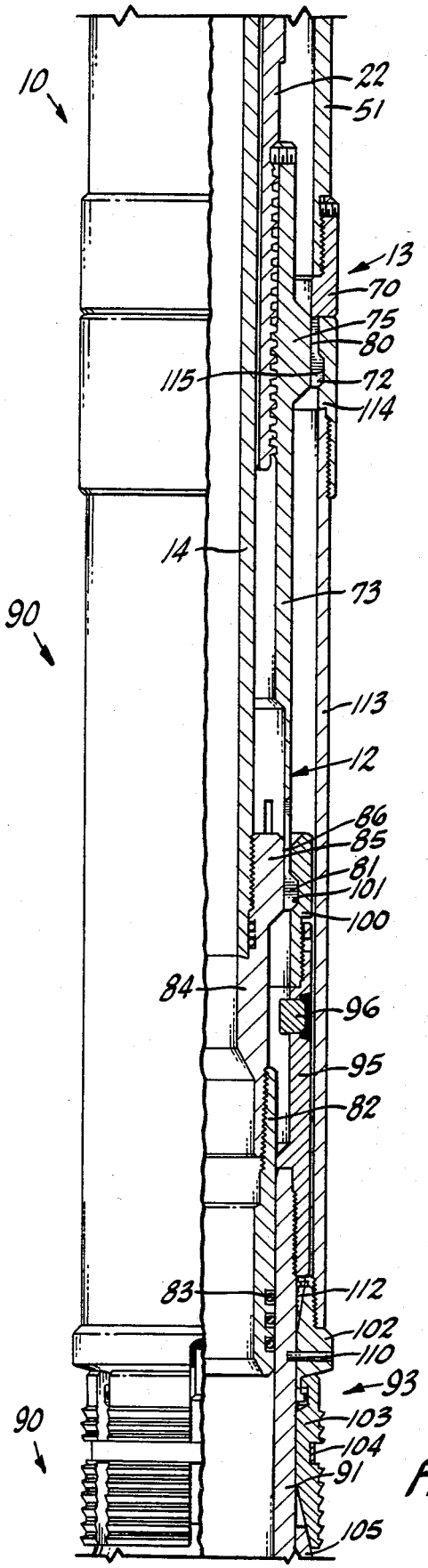
Figure 2D:
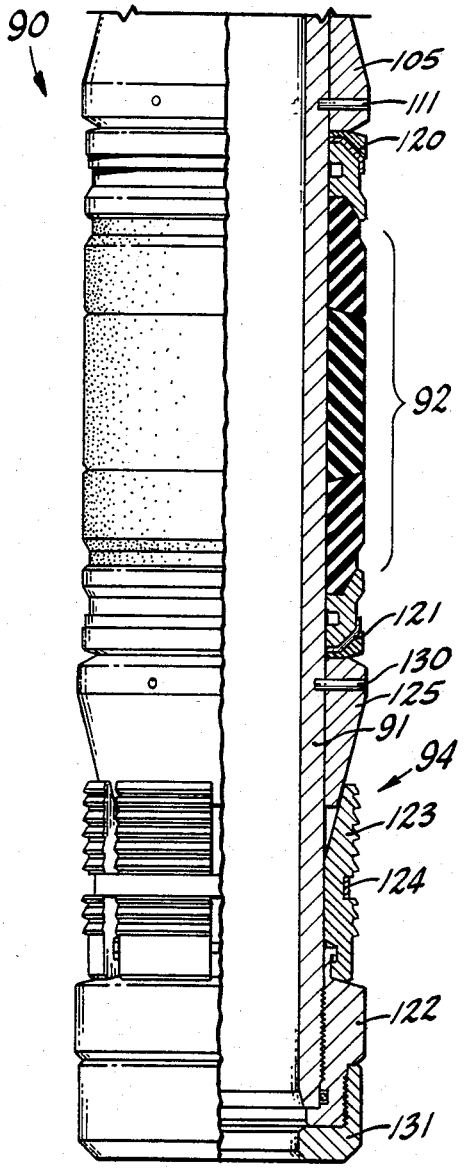

FIGS. 2A, 2B, 2C and 2D show the running tool 10 in running position coupled with a packer 90 which is run into a well bore and set with the running tool. Referring to FIGS. 2C and 2D, the packer 90 is basically a standard available Otis Engineering Corporation well packer Model 212WDC. The packer comprises a tubular body mandrel 91 which supports an annular expandable seal assembly 92 between an upper slip assembly 93 and a lower slip assembly 94. The seal assembly seals between the inner wall of a well casing and the packer mandrel while the packer is locked with the casing wall by the upper and lower slip assemblies. The upper end portion of the body 91 is threaded into a J-latch receiving head 95 provided with an internal lug 96 for connecting a seal unit, not shown, into the packer after it is set. A top sub 100 is threaded into the upper end of the head 95 provided with an internal annular locking recess 101 used in coupling the packer with the running tool. The upper slip assembly 93 includes an annular slip carrier 102 which supports circumferentially spaced upper slips 103 held around the carrier by a strap 104. The upper slips 103 are operable along a conical slip expander mandrel 105. The slip carrier 102 in the run position of the packer is releasably connected by shear pins 110 to the mandrel 91. Similarly the slip expander mandrel 105 is initially connected by shear pins 111 with the mandrel 91. The slip carrier 102 has a conical bore in which a plurality of internal locking slips 112 are disposed for preventing relative movement between the packer mandrel body 91 and the upper slip carrier 102 after the packer is set. A tubular extension 113 is threaded along a lower end portion on the upper slip carrier 102 extending upwardly concentrically around and above the top sub 100 on the packer mandrel. The extension tube 113 is provided with a top sub 114 which has an internal annular locking recess 115 which serves a locking function for the upper slip assembly in the running condition of the running tool and packer.

Referring to FIG. 2D, the packer seal assembly 92 is mounted between upper and lower backup shoes 120 and 121 which aid in containing and preventing extrusion of the seal elements of the assembly when the seal assembly is in expanded sealing condition along a well casing wall. The lower slip assembly 94 includes a lower slip carrier 122 threaded on the lower end portion of the packer mandrel 91, a plurality of circumferentially spaced lower slips 123 held around the packer mandrel by a strap 124, and a lower slip expander mandrel 125 which slides on the mandrel 91 and is initially connected by shear pins 130 with the mandrel. An annular cap 131 is threaded on the lower end of the lower slip carrier 122

FIGS. 2A, 2B, 2C and 2D show the relative positions of all of the parts of the running tool 10 and the packer 90 when the running tool is connected with the packer for lowering the packer in a well bore and setting the packer at a desired depth in the casing of a well. Referring to FIGS. 2A and 2B, the running tool operating tube 14 is connected at an upper end position with the top sub 15 of the running tool by shear pins 42 so that the upper and lower ring seals 47 and 48 respectively around the upper end portion of the tube 14 are located above and below the bypass ports 43. The annular piston 25 and the tube 45 of the running tool are at upper end positions with the collet fingers 54 on the tube 50 in locking positions within the recess 34. The tube 45 is connected by shear pins 140 with the tube 50. The shear pins 140 extend through the shear pin holes 63 in the tube 50 and 62 in the tube 45 holding the relative positions of the tubes 45 and 50 at positions at which the outer surface of the tube 45 below the release recess 53 is within the heads of the collets 54 holding the collets 54 outwardly at locked positions within the locking recess 34 so that the upper packer slip setting tube assembly 44 is held at an upper end locked position by the running tool. The pins 61 held by the ring 60 extend radially inwardly through the longitudinal slots 55 in the tube 50 into shear pin holes 141 circumferentially spaced around the tube 45 so that the ring 60 and pins 61 are moved longitudinally by the tube 45.

Referring to FIG. 2C, the collet fingers 72 of the collet 13 on the running tool tube 51 are engaged in the internal annular locking recess 115 in the top sub 114 on the packer setting sleeve extension tube 113 for holding the setting tube extension at an upper end position until the setting of the packer. The collet fingers 72 are held outwardly at the locked positions shown in FIG. 2C by the cylindrical locking surface 80 on the boss 75 of the tubular collet body 73 connected on the lower end of the running tool mandrel 22. As also shown in FIG. 2C the collet fingers 81 of the collet 12 are positioned within the internal annular locking recess 101 in the top sub 100 on the upper end of the packer body mandrel 91 forming the primary coupling between the running tool and the packer. The collet fingers 81 are held outwardly at the locked positions shown in FIG. 2C by the cylindrical external locking surface 86 on the boss 85 of the coupling 84 on the lower end of the running tool operator tube 14. The external seal rings 83 on the seal unit 82 on the lower end of the running tool operator tube fit in sealed relationship in the bore of the packer mandrel 91.

Thus, as illustrated in FIGS. 2A, 2B, 2C and 2D, when running the packer 90 into a well bore on the running tool 10 the collet fingers 54 on the tube assembly 44 lock the setting sleeve extension 113 of the packer against movement until time to set the packer and the collet fingers 81 on the collet 12 are locked with the packer body mandrel connecting the running tool with the packer until the packer is fully set and the running tool is to be disconnected from the packer. The packer is thus lowered on the running tool as illustrated with the top sub 15 of the running tool connected on the lower end of a tubular handling string, not shown, until the packer is at the desired setting depth. The running tool and packer are lowered with the bore of the packer and running tool and the supporting tubing string open so that fluids in the well may freely flow through the packer and running tool into the tubing string. Additional apparatus such as a tubing string with or without a seal unit, not shown, may if well conditions require be connected with and supported from the bottom of the packer. The weight of the packer and any equipment suspended from the packer is applied upwardly to the tubing string through the running tool with the various shear pins in the running tool isolated from weight forces. The force of the weight of the packer and related apparatus is applied through the top sub 100 on the upper end of the packer mandrel, to the collet fingers 81 on the collet 12 and upwardly to the running tool head through the collet body 73, the running tool body 22, and the top sub 15 of the running tool. Thus the shear pins serve only to restrain the running tool and packer in the running condition until forces are applied to set the packer.

When the packer 90 has been lowered on the running tool 10 to the desired depth, a ball 150 is dropped into the tubing string supporting the running tool. The ball drops downwardly to a seated position as shown in FIG. 2A on the upper end of the running tool operator tube 14 closing the bore through the running tool. Fluid pressure is then increased in the tubing string supporting the running tool above the ball 150. The fluid pressure is applied downwardly through the flow passages 40 in the running tool top sub 15 into the annular cylinder 24 above the annular piston 25. The downward force on the piston 25 is applied to the tube 45. Since the tube 45 is secured by the shear pins 140 to the tube 50 and the collet fingers 54 on the tube 50 are locked in the locking recess 34, the tube 45 cannot move downwardly until the pressure on the piston 25 is sufficient to exceed the resistance of the shear pins 140. When a predetermined pressure level is exceeded the pins 140 shear releasing the tube 45 to move downwardly. The piston 25 and the tube 45 move downwardly with the pins 61 sliding downwardly in the longitudinal slots 55 until the pins 61 engage the lower end edges of the slots. The downward force on the piston 25 and tube 45 is then applied through the pins 61 to the tube 50. At this lowered position of the tube 45 the release recess 53 around the tube 45 is within the collet finger heads 54 so that the collet fingers are free to spring inwardly out of the locking recess 34 releasing the tube 50 to move downwardly. Continued downward pressure on the annular cylinder 25 drives the tube 45 and the tube 50 downwardly forcing the tube 51 downwardly against the upper end of the packer setting sleeve extension 113. The downward force on the tube 51 is applied through the collet body 70 to the upper end edge of the top sub 114 on the tube extension 113. Continued downward force on the hydraulic piston 25 is thus applied through the tube assembly 44 and the packer tube extension 113 to the top slip carrier 102. When the downward force on the slip carrier is sufficient to shear the pins 110, the upper slip carrier 102 is released from the packer body mandrel 91 so that the downward force drives the slip carrier and the top slips 103 downwardly on the conical expander surface of the upper slip mandrel 105. As the slips are driven downwardly and outwardly the strap 104 expands and breaks allowing the slips to move along the expander surface into engagement with the inner wall surface of the well casing, not shown. When the slips engage the casing wall they are tightly wedged between the slip expander 105 and the casing thereby setting the upper slips and locking the packer against upward movement with the casing wall.

With the top slips 103 of the packer set, the setting sleeve extension 113 as well as the running tool tube assembly 44 and the annular piston 25 can move no farther downwardly. Since the downward movement of the piston 25 is stopped, further pressure increases through the tubing string into the annular cylinder 24 applies a lifting force on the running tool head raising the running tool body 22 lifting the collet 12 which applies an upward force through the collet fingers 81 to the top sub 100 connected through the member 95 with the packer mandrel 91. The upward force on the packer mandrel is transmitted to the pins 110 which shear releasing the packer mandrel 91 from the upper slip cone 105 which is wedged against the upper expanded slips 103. The upward movement of the running tool head and body may occur due to some compression in the tubing string supporting the running tool or, if a slip joint is used, the slip joint will accommodate the relatively small amount of upward movement required in the running tool head and body. The fluid lifting force in the cylinder 24 against the head and body of the running tool and the packer mandrel 91 lifts the lower slip cone 125 against the lower backup shoe 121 and the packer assembly 92 compressing the packer assembly and expanding the packer elements until they are tightly wedged in sealing relationship around the packer mandrel with the inner wall surface of the well casing. After the packer elements are expanded the continued upward force on the packer mandrel shears the pins 130 releasing the packer mandrel for continued upward movement relative to the lower slip cone 125. The lower slips 123 are lifted along the expander surface of the lower slip cone 125 stretching and breaking the strap 124 and setting the lower slips against the casing wall. The shear pins 61 are selected to remain unsheared throughout the process of setting the packer. After the lower slips 123 of the packer are set, continued hydraulic pressure applies a downward force on the annular piston 25 and an equal and opposite upward force against the lower end of the running tool head 15 tending to more tightly wedge the upper and lower slips against the casing wall and further expand the packer seal assembly. The inner slips 112 within the upper slip carrier 102 grip the outer wall of the packer mandrel 91 holding the packer mandrel against any tendency to move downwardly and thereby keeping the packer locked in the set condition. When the hydraulic pressure being applied into the annular cylinder 24 against the piston 25 exceeds a predetermined maximum packer setting pressure, the downward force on the tube 45 against the pins 61 shears the pins releasing the tube 45 to move farther downwardly until the piston 25 engages the stop shoulder 33 on the upper end of the member 32. Additional hydraulic pressure in the cylinder assembly tends to urge the piston 25 downwardly against the stop shoulder 33 and the head of the setting tool upwardly applying no force on the packer. Thus the shear pins 61 are selected to establish the maximum pressure which may be applied into the packer for setting the packer.

With the packer 90 set in the well bore, further hydraulic pressure in the tubing string into the running tool head applies downward force to the upper end of the operating tube 14 which is closed by the ball 150. When the downward force on the tube 14 exceeds a predetermined value, the pins 42 shear releasing the control tube to move downwardly to a lower end position as shown in FIG. 1A at which an external annular stop shoulder 16 on the control tube engages an internal annular stop shoulder 17 in the running tool head. At this lower end position of the operator tube 14 the upper end of the tube is below the bypass ports 43 so that further pressure will be expended outwardly through the bypass ports into the well bore around the tubing string supporting the running tool. The downward movement of the operator tube also releases the running tool from the packer by lowering the boss 85 below the collet fingers 81 on the collet 12 so that the locking surface 86 on the boss 85 is below the heads of the collet fingers no longer holding the collet fingers 81 outwardly in the locked positions within the locking recess 101 in the top sub 100 of the packer. As previously described, when the upper packer slips were set, the collet fingers 72 were moved downwardly relative to the locking surface 80 on the boss 75 thereby releasing the collet fingers 72 from the setting sleeve extension tube 113 of the packer. With the collet fingers 72 and 81 both no longer locked outwardly, an upward force on the running tool cams both set of collet fingers inwardly releasing the running tool from the packer for removal from the well bore. The packer 90 up through and including the setting sleeve extension 113 on the upper end of the packer remains set in the casing of the well bore. A production tubing string having a seal unit provided with a J-slot, not shown, may be lowered in the well bore and connected into the packer bore by landing and locking the seal unit in the upper end of the packer latching the seal unit with the lug 95 in the packer head.

It will be recognized that throughout the lowering and setting of the well packer 90 the packer remains latched by a collet with the running tool until the last specific pressure increase step is taken to release the running tool from the packer. The coupling between the running tool and the packer fully supports the packer and any apparatus connected to the packer through the collet without applying weight forces on the various sets of shear pins. Until the positive separate step of releasing the running tool from the packer is taken, upward and downward forces may be applied to the tubing string supporting the running tool to determine if the packer is properly set and the packer may be pressure tested without the running tool being disconnected from the packer. There is no risk of losing the packer in the well bore from the running tool due to shear pin wear or accidental failure.

What is claimed is:

1. A running and setting tool for a well packer having a body mandrel, a seal assembly, upper and lower slip assemblies, a setting sleeve for setting said upper slip assembly, and means on said body mandrel for setting said lower slip assembly, said tool comprising: a head assembly connectible with a supporting tubing string and including an annular cylinder and an annular piston; a tubular tool body secured at a first end into said head assembly; first releasable locking means on the second opposite end of said tool body for coupling said tool with said packer mandrel and applying weight forces on said packer mandrel to said tool; second locking means coupled with said annular piston for releasable locking with and operating said packer setting sleeve to set said upper slip assembly; and an operating tube releasably connected at a first end with said tool head assembly and having means along a second opposite end for operating said first locking means to release said tool from said packer mandrel after said packer is set in a well bore.

2. A running and setting tool in accordance with claim 1 wherein said first locking means comprises a collet assembly having radially movable collet fingers for releasable connection with said packer mandrel.

3. A running and setting tool in accordance with claim 2 wherein said means on said operating tube second end comprises an external locking surface coacting with said collet fingers of said first locking means for locking said collet fingers outwardly at a first position of said operating tube and removed from within said collet fingers at a second position of said operating tube.

4. A running and setting tool in accordance with claim 3 including means between said first end of said operating tube and said head assembly for holding said operating tube at a first locking position and for releasing said operating tube after said packer is set for movement to a second operating position releasing said first locking means coupling said tool with said packer mandrel.

5. A running and setting tool in accordance with claim 4 wherein said operating tube is releasably connected with said head assembly by shear pins sized to shear after said packer is set.

6. A running and setting tool in accordance with claim 5 including a shear pin coupling between said annular piston and said second locking means for disengaging said piston from said second locking means when a predetermined pressure level against said piston for setting said packer is exceeded.

7. A running and setting tool in accordance with claim 6 including a third locking means coupled with said annular piston for restraining movement of said piston for setting said upper slips until the pressure against said piston exceeds a predetermined level.

8. A running and setting tool in accordance with claim 7 wherein said third locking means includes radial collets for locking with said head assembly, means providing a collet locking surface within said collets movable by said piston, and shear pin means restraining said means providing said collet locking surface against movement until a predetermined pressure on said piston is exceeded for setting said upper slips.

9. A running and setting tool for a well packer having a body mandrel, a seal assembly, upper and lower slip assemblies, a setting sleeve for setting said upper slip assembly, and means on said body mandrel for setting said lower slip assembly, said tool comprising: a tubular head assembly having connecting means for securing said head assembly on a supporting tubing string and including an annular cylinder communicating with the bore through said head assembly; an annular piston movable in said annular cylinder; a tubular tool body connected at a first end with said head assembly and provided at a second opposite end with an annular collet lock having collet fingers insertable into a locking recess in the upper end of said packer body mandrel; an operating sleeve assembly coupled with said head assembly and engageable at a first end with said annular piston for operating said packer setting sleeve for setting said upper slip assembly including a second locking collet on said second opposite end of said operating sleeve assembly for releasable engagement in a locking recess in said packer setting sleeve; a third locking collet connected with said operator sleeve assembly and releasably engageable with a locking recess in said head assembly including shear pin means for restraining said operator sleeve assembly against movement until said upper slips are to be set; shear pin means associated with said operator sleeve assembly for deactivating said annular piston responsive to a predetermined pressure on said piston above the pressure level required for setting said packer; said tool body being provided with an external locking surface for holding said second collet lock engaged with said packer setting sleeve until said operator sleeve moves said packer setting sleeve for setting said upper slips moving said second collet lock out of alignment with said tool body locking surface; and an operator tube slidably disposed within the bore of said head assembly and body releasably secured along a first end with said head assembly and having a seal sub engageable in the bore of said packer and an external locking surface aligned within said first locking collet when said operator tube is at a first upper end position and said locking surface is misaligned from said first locking collet for releasing said tool from said packer when said operator tube is at a second end position and said operator tube is releasably securable with said head assembly at said first end position and movable to said second end position responsive to fluid pressure applied across said operator tube when the bore through said tube is closed by a ball dropped to the upper end of said tube.

10. A hydraulic running and setting tool for a well packer having a tubular body mandrel provided with an internal annular locking recess along an upper end thereof, an expandible packer assembly around said body mandrel, an upper slip assembly on said body mandrel, a setting sleeve on said body mandrel for setting said upper slip assembly including an internal annular locking recess along the upper end thereof, and a lower slip assembly on said body mandrel adapted to be set by movement of said body mandrel upwardly after said upper slip assembly is set, said running and setting tool comprising: a tubular top sub having an upper end portion adapted to be connected with a supporting tubing string; a tubular tool body secured along an upper end into said top sub; a first annular collet lock on the second opposite end of said tool body having radially movable collet heads engageable in said locking recess within the upper end of said packer mandrel; means providing an external annular boss around said tool body spaced from said first collet lock providing a collet locking surface on said tool body; a cylindrical skirt secured at a first end with said top sub in concentric spaced relation around said tool body defining with said tool body an annular hydraulic cylinder; said top sub having flow passages from the bore thereof into said annular cylinder; an annular piston movably disposed in said annular cylinder for movement therein responsive to hydraulic fluid introduced from said bore of said sub into said cylinder; said cylinder skirt being provided with an internal annular locking recess along a second opposite end portion thereof; an operator sleeve assembly movably disposed around said tool body having an upper end edge engageable by said annular piston for moving said sleeve assembly downwardly to set said upper slip assembly of said packer and having a second locking collet along a second lower end engageable with said locking recess at the upper end of said setting sleeve of said packer, said sleeve assembly including a first section telescoping into said annular cylinder and engageable with said annular piston at a first upper end and having a second end portion extending from said cylinder skirt and having an external annular collet release recess spaced from said second end, said sleeve assembly having a second section telescoping along an upper end portion over said lower end portion of said first section, said second section having a third locking collet formed on said first upper end thereof engageable with said locking recess within said second end portion of said cylinder skirt for locking said sleeve assembly against downward movement until released for setting said upper packer slips; first shear screws connecting said first and said second sections of said operator sleeve assembly at relative positions at which said release recess on said first section is misaligned from said collet fingers on said second section locking said collet fingers at outward locking positions within said locking recess of said cylinder skirt and said first section telescoping into said second section after said first shear screws shear sufficiently to permit release of said third collet lock from said cylinder skirt for setting said upper packer slip assembly; said second section of said operator sleeve assembly having circumferentially spaced longitudinal slots longitudinally spaced from said collet lock fingers on said upper end of said second section; a shear pin retainer ring slidably disposed around said second section of said operator sleeve assembly along said longitudinal slots therein; shear pins through said shear pin retainer ring and said longitudinal slots into said first section of said operator sleeve assembly, said second shear pins being engageable with end edges of said longitudinal slots for moving said operator sleeve assembly responsive to hydraulic fluid pressure on said annular cylinder to set said upper packer slip assembly and said second shear pins being shearable at a pressure level against said annular piston above a predetermined setting pressure for said well packer for releasing said first section from said second section of said operator sleeve assembly to deactivate said annular piston above said packer setting pressure; an operator tube disposed in the bore of said top sub and said tool body including a seal sub along the lower end thereof engageable in sealed relationship in the bore of said packer mandrel, said operator tube being movable between a first upper end position and a second lower end position, sald operator tube being provided with an external annular boss having a locking surface thereon aligned within said first locking collet when said operator tube is at said first upper end position for locking said tool with said packer mandrel and said locking surface being misaligned from said first locking collet when said operator tube is at said second end position for releasing said tool from said packer, said operator tube having a ball seat surface on the upper end edge thereof for receiving a ball member to close the bore through said operator tube for applying hydraulic pressure to force said operator tube downwardly from said first position to said second position to release said tool from said packer; shear pin means releasably securing said operator tube with said top sub of said tool at said upper end position of said operator tube, said shear pins being shearable at a pressure in excess of the setting pressure for said packer; said first locking collet applying all weight on said packer to and through said tool body into said top sub for supporting weight forces independently of shear screws in said packer and said running and setting tool whereby all of said shear screws are isolated from weight forces during the running of said packer.

11. A running and setting tool for a well packer having a body mandrel, a seal assembly, upper and lower slip assemblies, a setting sleeve for setting said upper slip assembly, and means on said body mandrel for setting said lower slip assembly, said tool comprising: a head assembly connectible with a supporting tubing string and including an annular cylinder and an annular piston; a tubular tool body secured into said assembly; first releasable locking means on said tool body for coupling said tool with said packer mandrel and applying weight forces on said packer mandrel to said tool; second locking means coupled with said annular piston for releasable locking with and operating said packer setting sleeve to set said upper slip assembly; and an operating tube releasably connected with said tool head assembly and having means for operating said first locking means to release said tool from said packer mandrel after said packer is set in a well bore.

12. A running and setting tool in accordance with claim 11 wherein said first locking means comprises a collet assembly having radially movable collet fingers for releasable connection with said packer mandrel.

13. A running and setting tool in accordance with claim 12 wherein said means on said operating tube for operating said first locking means comprises an external locking surface coacting with said collet fingers of said first locking means for locking said collet fingers outwardly at a first position of said operating tube and removed from within said collet fingers at a second position of said operating tube.

14. A running and setting tool in accordance with claim 13 including means between said operating tube and said head assembly for holding said operating tube at a first locking position and for releasing sid operating tube after said packer is set for movement to a second operating position releasing said first locking means coupling said tool with said packer mandrel.

15. A running and setting tool in accordance with claim 14 including a third locking means coupled with said annular piston for restraining movement of said piston for setting said upper slips until the pressure against said piston exceeds a predetermined level.

16. A running and setting tool in accordance with claim 15 wherein said third locking means includes radial collets for locking with said head assembly, means providing a collet locking surface within said collets movable by said piston, and shear pin means restraining said means providing said collet locking surface against movement until a predetermined pressure on said piston is exceeded for setting said upper slips.

* * * * *

UNITED STATES PATENT AND TRADEMARK OFFICE

CERTIFICATE OF CORRECTION

PATENT NO. : 4,516,634

DATED : May 14, 1985

INVENTOR(S) : Glen E. Pitts

It is certified that error appears in the above-identified patent and that said Letters Patent is hereby corrected as shown below:

Column 12, line 8, after "said" insert --head--.

Column 12, line 34, delete "sid" and insert --said--.

Signed and Sealed this

*Third* Day of *September 1985*

[SEAL]

*Attest:*

DONALD J. QUIGG

*Attesting Officer* *Acting Commissioner of Patents and Trademarks - Designate*